US007595288B2

(12) United States Patent
Fretz et al.

(10) Patent No.: US 7,595,288 B2
(45) Date of Patent: Sep. 29, 2009

(54) ANTIMICROBIAL METAL WORKING FLUIDS

(75) Inventors: Mark J. Fretz, Lafayette, IN (US); Paul Kutzko, Livonia, MI (US)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 268 days.

(21) Appl. No.: 11/051,362

(22) Filed: Feb. 4, 2005

(65) Prior Publication Data

US 2005/0197262 A1 Sep. 8, 2005

Related U.S. Application Data

(60) Provisional application No. 60/542,672, filed on Feb. 6, 2004.

(51) Int. Cl.
*C10M 133/04* (2006.01)
*C10M 169/04* (2006.01)
*C10M 133/44* (2006.01)
*C10M 173/02* (2006.01)

(52) U.S. Cl. ..... 508/559; 508/279; 508/156

(58) Field of Classification Search ..... 508/559, 508/279, 156

See application file for complete search history.

(56) References Cited

U.S. PATENT DOCUMENTS

| | | | | | |
|---|---|---|---|---|---|
| 3,382,032 | A | | 5/1968 | Cox | 422/42 |
| 4,348,210 | A | | 9/1982 | Sung | 44/407 |
| RE31,242 | E | * | 5/1983 | Andlid et al. | 508/487 |
| 4,659,490 | A | * | 4/1987 | Louthan et al. | 508/268 |
| 4,839,067 | A | | 6/1989 | Jansen | 508/527 |
| 5,073,280 | A | | 12/1991 | Rossio et al. | 508/410 |
| 5,132,046 | A | | 7/1992 | Edebo et al. | 508/156 |
| 5,182,035 | A | | 1/1993 | Schmidt et al. | 508/527 |
| 5,512,191 | A | | 4/1996 | Krueger | 508/250 |
| 5,549,836 | A | * | 8/1996 | Moses | 508/183 |
| 5,633,222 | A | | 5/1997 | Skold et al. | 508/562 |
| 5,723,418 | A | * | 3/1998 | Person Hei et al. | 508/511 |
| 5,863,874 | A | | 1/1999 | Hei et al. | 508/521 |
| 5,932,526 | A | * | 8/1999 | Person Hei et al. | 508/559 |
| 6,001,782 | A | * | 12/1999 | Huang | 508/420 |
| 6,214,777 | B1 | | 4/2001 | Li et al. | 508/388 |
| 6,316,394 | B1 | | 11/2001 | Morgan et al. | 508/429 |
| 2002/0016266 | A1 | * | 2/2002 | Fletschinger et al. | 508/433 |

FOREIGN PATENT DOCUMENTS

| | | | |
|---|---|---|---|
| EP | 533 552 | A1 | 3/1993 |
| EP | 533552 | A1 * | 3/1993 |
| WO | WO 95/26389 | A1 | 10/1995 |

OTHER PUBLICATIONS

Tomah Ether Amines product information, May 2, 1996, <http://www.tomah3.com/products/ProdImages/P-02.pdf>, retrieved from the internet on May 21, 2007.*

Wallace, Jr., R. J. et al., "Presence of a Single Genotype of the Newly Described Species *Mycobacterium immunogenum* in Industrial Metalworking Fluids Associated with Hypersensitivity Pneumonitis," *Applied and Environmental Microbiology*, vol. 68, No. 11, p. 5580-5584, Nov. 2002.

* cited by examiner

*Primary Examiner*—Glenn Caldarola
*Assistant Examiner*—Jim Goloboy
(74) *Attorney, Agent, or Firm*—Woodcock Washburn LLP

(57) ABSTRACT

Aqueous alkaline metal working fluids and concentrates thereof and processes for their use are disclosed. Processes to reduce the presence of Mycobacteria in a metal working environment are also disclosed.

42 Claims, No Drawings

ANTIMICROBIAL METAL WORKING FLUIDS

CROSS REFERENCE TO RELATED APPLICATION

This application claims priority to U.S. Provisional Application Ser. No. 60/542,672, filed Feb. 6, 2004, the entire disclosure of which is incorporated herein by reference in its entirety.

FIELD OF THE INVENTION

The present invention generally relates to metal working fluids and their uses. The present invention relates to aqueous alkaline metal working fluids and concentrates thereof and processes for their use while diminishing the likelihood of microbial proliferation. In certain embodiments, the processes reduce the presence of Mycobacteria in aqueous alkaline metal working fluids or in a metal working environment.

BACKGROUND OF THE INVENTION

The increasing cost and disposal problems of non-aqueous, oil based functional fluid compositions has accelerated the demand for aqueous based functional fluid compositions. Aqueous based metalworking fluids have been gaining in importance over non-aqueous metalworking fluids because of their economic, environmental and safety advantages. Water based metalworking fluids have been used in chip forming and non-chip forming metalworking processes well known in the art such as drilling, tapping, broaching, grinding, rolling, drawing, spinning, milling, bending, turning and stamping.

Typically, metal working fluids are used in open systems and are exposed to bacteria and other microorganisms. It has been recognized that certain fast growing, easily recognizable bacteria affect fluid performance in use or during extended storage. Use of antimicrobials in aqueous alkaline industrial fluids to reduce the deterioration of fluid performance caused by microbial action on fluid components over time is known in some circumstances.

Due to their comparatively slow growth, other, more resistant, microorganisms, such as Mycobacter have been the focus of less concern. One possible reason for this may be that significant deterioration and hence lowered performance of these industrial fluids by slow-growing organisms is considered relatively unlikely. More recently, it has been proposed that high levels of Mycobacter may be related to respiratory health effects associated with occupational exposure to metal working fluids, including occupational asthma, bronchitis, and hypersensitivity pneumonitis. Wallace, Jr., R. J. et al., "Presence of a Single Genotype of the Newly Described Species *Mycobacterium immunogenum* in Industrial Metalworking Fluids Associated with Hypersensitivity Pneumonitis", *Applied and Environmental Microbiology*, Vol. 68, No. 11, p. 5580-5584, November 2002. Long periods of time between complete changes out of sumps containing recirculating metal working fluids may lead to sizable Mycobacter populations. Significant aerosol levels encountered in certain metal working environments tend to increase the potential for worker exposure.

In some situations, formalin or compounds evolving formalin or formaldehyde have been used to reduce bacterial populations. Elevated working temperatures experienced in some metal working processes may lead to substantial volatilization of formalin or formaldehyde or breakdown of formalin precursors, requiring routine reintroduction of these compounds into the working fluid. In addition, in open systems, and in particular those systems that generate aerosols, such as metal working environments, formalin raises its own environmental and health-related concerns for worker exposure. Another drawback of these formaldehyde-related systems is that they appear ineffective against opportunistic microorganisms such as *Mycobacter*.

A limited number of other antimicrobials such as chlorinated phenols, isothiazolinones and dicyclohexylamine have been found to have some efficacy against Mycobacteria in certain situations. Their utilization in metal working fluid operations and environments is hampered by drawbacks in the areas of worker safety, wastewater management, or stability. For example, chlorinated phenols are highly regulated by the EPA in waste streams. Isothiazolinones are expensive, sensitizing agents to tissue, and are not stable in alkaline environments. Pure dicyclohexylamine is toxic by ingestion and absorption and corrosive to the respiratory system.

As a means of extending fluid life and performance, certain secondary alkanolamines have been employed as antimicrobial agents to reduce component deterioration by *Pseudomonas* or *Fusarium* species. R. Skold and P. Raune, U.S. Pat. No. 5,633,222; L. Edebo and M. Sandin, U.S. Pat. No. 5,132,046. Certain antimicrobial lubricants that include an alkyl ether amine component have found use in food or beverage container conveyor systems. It has been proposed that these lubricants are useful in reducing slime formation caused by microbial action on food residues, thus improving conveyor performance. Hei, et al. U.S. Pat. No. 5,863,874; Hei, et al. U.S. Pat. No. 5,723,418; and Hei et al. U.S. Pat. No. 5,932,526.

The extent of broad spectrum antimicrobial activity and the level of efficacy for the general class of ether amines appear unpredictable. Hei, et al., U.S. Pat. No. 5,863,874, and Li, et al. U.S. Pat. No. 6,214,777, each disclose lubricating compositions which may include an ether amine for use in conveyor systems where external stresses, such as working temperature or working pressure, are minimal. In Hei, et al. ('874'), certain ether amines have ascertainable activity against some microorganisms under certain conditions. Under similar working conditions Li et al. discloses certain ether amines at much increased loadings which require a quaternary phosphonium compound as an antimicrobial to achieve the desired effect. External stresses such as elevated temperatures or pressures imposed by the working environment of processes such as metal working may further impact efficacy of certain ether amines through undesired thermal degradation, side reactions, volatilization, and the like. Under working conditions with increased external stresses, it is difficult to predict whether certain ether amines would have broad spectrum activity, a more limited range of activity against some microorganisms, or no activity at all.

There is a need to provide new metal working fluids and methods of their use that inhibit microbial growth including Mycobacteria in metal working fluids as well as metal working environments. There is also a need to provide new metal working fluids that remain effective against Mycobacteria after exposure to workpiece-tool contact zone working pressures of greater than about 60 psi or workpiece-tool contact zone working temperatures of greater than about 50° C. in metal working fluids as well as metal working environments. The present invention is directed to these and other important ends.

SUMMARY OF THE INVENTION

The present invention generally relates to metal working fluids and their uses. The present invention provides aqueous alkaline metal working fluids and concentrates thereof and processes for their use. In some embodiments, the metal working fluids of this invention inhibit growth of Mycobacteria or reduce the presence of Mycobacteria in a metal working environment.

Mycobacteria, Mycobacter and *Mycobacterium* all refer to a genus of relatively slow-growing microorganisms that have a coating external to their cell walls. These bacteria are often resistant to typical bactericidal treatments used in metalworking fluid applications. The level of these opportunistic microorganisms increase in both the working fluids and the adjoining metal working environments with time, even after treatment with typical biocides. While not wishing to be held to any one theory, it is believed that Mycobacter are an opportunistic bacteria whose proliferation is suppressed while other more rapid growing species of bacteria such as *Pseudomonas* or fungi such as *Fusarium* are present. Typical antimicrobial treatments of metal working fluids reduce these more susceptible, rapid-growing species and allow Mycobacter to proliferate due to their resistance to the typical antimicrobials.

A workpiece-tool contact zone is the area where the tool and workpiece surfaces are in contact with each other during the metal working operation and areas immediately adjacent thereto. Metal working fluids are exposed to the greatest environmental stresses in the workpiece-tool contact zone. In certain metal working fluid operations, such as for example, cutting, shaping, molding extruding, pressing and the like, the interaction of the metal being worked and the tool used to modify the workpiece generates significant pressure or heat. Generally, this pressure or heat is referred to as working pressure or working temperature respectively. Working pressures and working temperatures are the pressures and temperatures experienced by the metal surfaces and the aqueous alkaline metal working fluids at the contact zone during the metal working operation. Working temperatures in a workpiece-tool contact zone range from about 50-1500° C. or more, typically involving working temperatures of 50, 100, 150, 200, 300, 500, 1000 or 1500° C. Working pressures in a workpiece-tool contact zone range from about 60-10000 pounds per square inch (psi), typically involving contact zone working pressures of 60, 100, 500, 2000 or 10000 psi, or more. The present invention provides utility and reusability in these environments. Any additives to the working fluid must be able to withstand one or more of these extreme conditions and maintain their effectiveness.

An aqueous alkaline metalworking fluid according to this invention may optionally contain various additives well known in the art such as for example corrosion inhibitors, surfactants, emulsifiers, extreme pressure additives, antifoam agents and antimisting agents. The compositions and usable concentrations of these additives are well known in the art and such compositions and concentrations may be optionally employed in the practice of this invention. Any of the various additives may be employed in the invention provided that their use does not interfere with the desired antimicrobial action.

In one embodiment, the invention is directed to aqueous alkaline metal working fluids comprising from about 10 to about 20,000 ppm of at least one alkyl ether amine having the formula Ia or Ib:

Ia

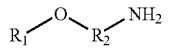

Ib

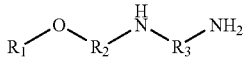

and an extreme-pressure additive. In any of the formula Ia or Ib alkyl ether amines, $R_1$ is independently $C_2$-$C_{18}$ alkyl. In certain other preferred embodiments, $R_1$ is independently $C_2$-$C_{10}$ alkyl. Alternatively, $R_1$ is independently $C_8$-$C_{10}$ alkyl, or $R_1$ is independently $C_8$-$C_{10}$ alkyl or $C_{12}$-$C_{14}$ alkyl. In other preferred embodiments, at least one $R_1$ is $C_2$-$C_8$ alkyl. In formula Ia or Ib alkyl ether amines, $R_2$ and $R_3$ are each independently an alkylene having two to ten carbon atoms. Preferably, each $R_2$ and $R_3$ is independently $C_2$-$C_4$ alkylene. More preferably, at least one of $R_2$ and $R_3$ is —$CH_2CH_2CH_2$—. Even more preferably each $R_2$ and $R_3$ is —$CH_2CH_2CH_2$—. In certain preferred embodiments, $R_1$ is independently $C_2$-$C_{10}$ alkyl and each $R_2$ and $R_3$ is independently $C_2$-$C_4$ alkylene. Even more preferably, the amine has the formula:

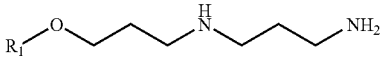

where $R_1$ is independently $C_8$-$C_{10}$ alkyl. In some preferred embodiments, the aqueous alkaline metal working fluids further comprise a workpiece corrosion inhibitor, a film forming additive, an antifoaming agent, or a less than detersive amount of surfactant.

Extreme pressure additives reduce tool wear while increasing work speed, thus making it possible to cut hard metals and increase production rates. The three distinct varieties of extreme pressure additives are phosphate esters, active sulfur (polysulfides), and chlorinated additives. Typical examples of extreme pressure additives include but are not limited to phosphate esters such as polyoxyethylene oleyl ether phosphate and other phosphates; polysulfides having one or more reduced sulfur atoms capable of forming metal sulfide such as di-tert-dodecyl polysulfides and di-tert nonyl polysulfides; and chlorinated hydrocarbon additives carbon based molecules with chlorine substituted for hydrogens, wherein the chlorine content in the molecule is usually greater than about 5% by weight. Chloroalkanes or chlorinated carboxylic acids, such as octadecanoic acid are typical examples of chlorinated hydrocarbon extreme pressure additives.

Workpiece corrosion inhibitors are additives used in metal working fluids to reduce the amount of corrosion caused by the presence of water that pools in depressions and imperfections of the workpiece or tool surface. Any workpiece corrosion inhibitors known in the art are suitable provided that they do not interfere with the desired antimicrobial features of the invention. Examples of workpiece corrosion inhibitors are ethanolamine combined with boric acid, triazole compounds such as benzotriazole or tolytriazole, organic carboxylic acids having 6-10 carbon atoms, or dicarboxylic acids having 10-14 carbon atoms, or any mixtures thereof.

Anti-foaming agents are additives used to reduce foaming in aqueous alkaline metal working fluids which may interfere with metal working processes. Foaming is undesirable in metal working operations because it may reduce cooling at the workpiece-tool contact zone and causes numerous containment transport and control problems. Examples include siloxane glycol copolymers, polyether modified polysiloxanes, reaction products of silicon dioxide and organosiloxanes, organosiloxane polymers, hydrophobically treated silica or ethoxylated/propoxylated hydrocarbons, or mixtures thereof.

The esters, fatty acids and oils in metal working fluids form films on the surfaces of tools and work pieces that they contact during metal working operations. The films are typically formed when the polarities of the esters, fatty acids and oils associate with the charges on the metal surfaces. Any film forming additive is suitable so long as it does not interfere with the stability, reusability or antimicrobial action of the metal working fluid. Mineral oils form a hydrodynamic boundary between the tool and work piece. This film acts as a boundary to lubricate the tool and work piece contact zone.

A "detersive amount of surfactant" refers to an amount of surfactant required in a liquid to make it act as a detergent, that is to effectively clean soils and oils from a surface. Surfactants alone are not very efficient detergents, but act in combination with other components in a cleaning liquid to provide a detergent action. Typically, an amount of a surfactant is added to a liquid as an aid or adjuvant to assist in providing detergent action. A detersive amount of surfactant depends on the presence of other components available to form a detergent. In some embodiments of the present invention the metal working fluid comprises surfactant. This surfactant is provided in amounts that are less than detersive amounts due to the absence of other components available in the metal working fluid to provide detergent action. In the present invention, the surfactant is provided to adjust the HLB "hydrophile/lipophile balance" and aid the dispersion of the metal working fluid concentrate in water. No detergent action is desirable or provided. The removal of protective oils on a workpiece in a metal working environment is undesirable due to the flash rusting of a workpiece within short periods of time in the absence of protective coatings. Also, a detersive amount of surfactant in aqueous alkaline fluids is likely to demonstrate a significant degree of foaming that is undesirable in operations involving metal working fluids. This foaming is exacerbated by the high pressure introduction of metal working fluid to the workpiece tool contact zone which causes turbulence resulting in increased foaming. A "less than detersive amount of surfactant" in a metal working fluid does not increase the fluid's ability to clean soils and oils from the workpiece or tool, or create significant levels of foaming.

In certain preferable embodiments, the aqueous alkaline metal working fluids, after exposure to workpiece-tool contact zone working temperatures of greater than about 50° C. or working pressures of greater than about 60 psi, remain effective against growth of Mycobacteria. Working temperatures in a workpiece-tool contact zone range from about 50-1500° C. or more. In some preferred embodiments the metal working fluids are exposed to working temperatures of 50, 100, 150, 200, 300, 500, 1000 or 1500° C. in the workpiece-tool contact zone. Working pressures in a workpiece-tool contact zone range from about 60-10,000 psi. In some preferred embodiments the metal working fluids are exposed to working pressures of 60, 100, 500, 2000 or 10000 psi, or more in the workpiece-tool contact zone.

In other preferred embodiments, the aqueous alkaline metal working fluid remains stable after exposure to workpiece-tool contact zone working temperatures. By stable, it is meant that the metal working fluids are reusable, that is they neither separate into layers in the sump nor appreciably decompose at the workpiece-tool contact zone or in the sump after exposure to working temperatures in the workpiece-tool contact zone. Preferably the level of decomposition of the metal working fluids is less than about 50%, more preferably less than about 40%, even more preferably less than about 20%, still more preferably less than about 10%, yet more preferably less than about 1%. Most preferably, the metal working fluid is essentially unchanged after exposure to workpiece-tool contact zone working temperatures.

Aqueous alkaline metal working fluids are subject to normal degradation over time such as from contact with local aqueous diluents or exposure to light or air. In addition, these fluids are often exposed to extreme stresses such as elevated pressure or temperature, especially in the workpiece-tool contact zone which may assist in the degradation of the fluid components. As a consequence, every aqueous alkaline metal working fluid has a finite lifetime in use and must necessarily be replaced. Typically, this occurs by incrementally removing a small portion of the fluid from service and replacing this with an equivalent amount of virgin working fluid. Aqueous alkaline metal working fluids of the present invention behave similarly, and typically have comparable lifetimes to analogous working fluids that do not contain the ether amines of the invention.

In yet other embodiments, the invention is directed to processes for inhibiting microbial growth in aqueous alkaline metal working fluids. The processes comprise the incorporation of a *Mycobacterium* inhibitory effective amount of at least one amine of the above formula Ia or Ib alkyl ether amines, wherein $R_1$ is independently $C_2$-$C_{18}$ alkyl, and $R_2$ and $R_3$ are each independently an alkylene having two to ten carbon atoms, preferably $C_2$-$C_4$ alkylene, into aqueous alkaline metal working fluids. An "inhibitory effective amount" refers to an amount of at least one amine compound of the present invention that may prevent, inhibit, or diminish the rate of Mycobacter growth relative to its growth in the absence of the claimed amine compound in an aqueous alkaline metal working fluid or a metal working environment. Typical levels of amine in the aqueous alkaline metal working fluid include but are not limited to from about 10 to about 20,000 ppm.

In certain preferred embodiments directed to processes for inhibiting microbial growth in aqueous alkaline metal working fluids each $R_1$ is independently $C_8$-$C_{10}$ alkyl. More preferably, when each $R_1$ is independently $C_8$-$C_{10}$ alkyl, each $R_2$ and $R_3$ is —$CH_2CH_2CH_2$—. In other preferred embodiments, each $R_2$ and $R_3$ is —$CH_2CH_2CH_2$—, or each $R_1$ is independently $C_8$-$C_{10}$ or $C_{12}$-$C_{16}$ alkyl. More preferably, when each $R_1$ is independently $C_8$-$C_{10}$ or $C_{12}$-$C_{16}$ alkyl, each $R_2$ and $R_3$ is —$CH_2CH_2CH_2$—. In yet other preferred embodiments, at least one $R_1$ is $C_2$-$C_8$ alkyl.

The invention also provides processes for reducing the presence of Mycobacteria in aqueous alkaline metal working environments. In these processes, the aqueous alkaline metal working fluids comprise the incorporation at least one of the above alkyl ether amines of formula Ia or Ib, wherein $R_1$ is independently $C_2$-$C_{18}$ alkyl, and $R_2$ and $R_3$ are each independently an alkylene having two to ten carbon atoms, preferably $C_2$-$C_4$ alkylene, at a level sufficient to inhibit the proliferation of Mycobacteria in metal working environments. In certain preferred embodiments, each $R_1$ is independently $C_8$-$C_{10}$ alkyl. More preferably, when each $R_1$ is independently $C_8$-$C_{10}$ alkyl, each $R_2$ and $R_3$ is —$CH_2CH_2CH_2$—. In other preferred embodiments, each $R_2$ and $R_3$ is —$CH_2CH_2CH_2$—, or each $R_1$ is independently $C_8$-$C_{10}$ or $C_{12}$-$C_{16}$ alkyl. More preferably, when each $R_1$ is independently $C_8$-$C_{10}$ or $C_{12}$-$C_{16}$ alkyl, each $R_2$ and $R_3$ is —$CH_2CH_2CH_2$—. In yet other preferred embodiments, at least one $R_1$ is $C_2$-$C_8$ alkyl.

Typically, a metal working environment includes any airspace, liquid or solid surface on or in reasonable proximity to the workpiece being modified, the tool modifying the workpiece or the sumps, pumps, reservoirs or other equipment used to move or circulate the metal working fluid at the location where the metal working is taking place. Notably, such environments include those occupied by workers operating metal working machinery who may come into contact with microbiological agents such as Mycobacter.

The invention also provides aqueous alkaline metal working fluids comprising: from about 10 to about 20,000 ppm of at least one alkyl ether amine having the formula Ia or Ib:

Ia

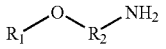

Ib

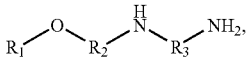

wherein each $R_1$ is independently $C_2$-$C_{18}$ alkyl and each $R_2$ and $R_3$ is independently $C_2$-$C_{10}$ alkylene; which after exposure to workpiece-tool contact zone working temperatures of greater than about 200° C. remain effective against growth of Mycobacteria. Preferably, the aqueous alkaline metal working fluids remain stable after exposure to workpiece-tool contact zone working temperatures. Working temperatures in a workpiece-tool contact zone range from about 50-1500° C. or more. In some preferred embodiments the metal working fluids are exposed to working temperatures of 50, 100, 150, 200, 300, 500, 1000 or 1500° C. in the workpiece-tool contact zone. Working pressures in a workpiece-tool contact zone range from about 60-10,000 psi. In some preferred embodiments the metal working fluids are exposed to working pressures of 60, 100, 500, 2000 or 10000 psi, or more in the workpiece-tool contact zone.

The invention also provides aqueous alkaline metal working fluids comprising at least one amine having the formula Ia or Ib:

Ia

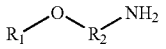

Ib

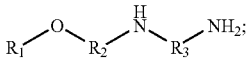

in an amount effective to inhibit *Mycobacterium* growth; and an antifoaming agent.

In any of the formula Ia or Ib alkyl ether amines, $R_1$ is independently $C_2$-$C_{18}$ alkyl. In certain other preferred embodiments, $R_1$ is independently $C_2$-$C_{10}$ alkyl. Alternatively, $R_1$ is independently $C_8$-$C_{10}$ alkyl, or $R_1$ is independently $C_8$-$C_{10}$ alkyl or $C_{12}$-$C_{14}$ alkyl. In other preferred embodiments, at least one $R_1$ is $C_2$-$C_8$ alkyl. In formula Ia or Ib alkyl ether amines, $R_2$ and $R_3$ are each independently an alkylene having two to ten carbon atoms. Preferably, each $R_2$ and $R_3$ is independently $C_2$-$C_4$ alkylene. More preferably, at least one of $R_2$ and $R_3$ is —$CH_2CH_2CH_2$—. Even more preferably each $R_2$ and $R_3$ is —$CH_2CH_2CH_2$—. In some preferred embodiments, the aqueous alkaline metal working fluids further comprise a workpiece corrosion inhibitor, a film forming additive, an antifoaming agent, or a less than detersive amount of surfactant. In certain preferred embodiments, $R_1$ is independently $C_2$-$C_{10}$ alkyl and each $R_2$ and $R_3$ is independently $C_2$-$C_4$ alkylene. Even more preferably, the amine has the formula:

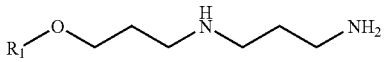

where $R_1$ is independently $C_8$-$C_{10}$ alkyl.

Some embodiments provide a metal working fluid concentrate comprising: at least one amine having the formula Ia or Ib:

Ia

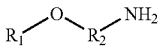

Ib

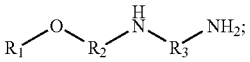

wherein each $R_1$ is independently $C_2$-$C_{18}$ alkyl; and each $R_2$ and $R_3$ is independently $C_2$-$C_{10}$ alkylene; and at least one of an extreme-pressure additive, antifoaming agent, workpiece corrosion inhibitor or combination thereof. These concentrates provide aqueous alkaline metal working fluids that are effective in inhibiting *Mycobacterium* growth when diluted.

Aqueous alkaline metal working fluids of the invention have from about 10 to about 20,000 ppm of at least one amine of formula Ia or Ib. Preferable aqueous alkaline metal working fluids have from a bout 3000 to about 6000 ppm of the amine. More preferably, the aqueous alkaline metal working fluid has about 3000 ppm of the amine. Metal working fluid concentrates of the invention have levels of the required amine which may exceed 20,000 ppm. The level of amine in the concentrate depends on the dilution factor necessary to convert the concentrates into aqueous alkaline metal working fluids. For example, if a concentrate requires a dilution factor of 10, then the concentrate may contain from about 100 to about 200,000 ppm of the amine of formula Ia or Ib. Similarly, a concentrate requiring a dilution factor of 50 may contain from about 500 to about 1,000,000 ppm of the amine. Aqueous alkaline metal working fluids may comprise more than 20,000 ppm and their concentrates may comprise proportionately more based on their dilution factors. These higher levels of amine may be used but are not economically preferred.

As employed above and throughout the disclosure, the following terms, unless otherwise indicated, shall be understood to have the following meanings.

"Alkyl" refers to an optionally substituted, saturated straight, branched, or cyclic hydrocarbon having from about 1 to about 20 carbon atoms (and all combinations and subcombinations of ranges and specific numbers of carbon atoms therein which do not adversely affect ether amine solubility in the metal working fluid or metal working fluid performance. Preferably, the alkyl is a straight chain hydrocarbon. Alkyl groups include, but are not limited to, methyl, ethyl, n-propyl, isopropyl, n-butyl, isobutyl, t-butyl, n-pentyl, cyclopentyl, isopentyl, neopentyl, n-hexyl, isohexyl, cyclohexyl, cyclooctyl, 3-methylpentyl, 2,2-dimethylbutyl, and 2,3-dimethylbutyl, 2-ethylhexyl, octyl, decyl, undecyl, dodecyl, tridecyl, tetradecyl, pentadecyl, hexadecyl, heptadecyl, octadecyl, nonadecyl, and eicosyl.

"Alkylene" refers to a bivalent alkyl radical having the general formula —$(CH_2)_n$—, where n is 2 to 10. Non-limiting examples include methylene, trimethylene, pentamethylene, and hexamethylene. Alkylene groups can be substituted or unsubstituted. In some embodiments, n is preferably 2 to 4. In some more preferable embodiments, n is 3. In other embodiments, the alkylene moiety has one or more alkyl branches. In these embodiments the sum of the number of carbon atoms in the alkylene and alkyl branches is an integer in the range of 2 to 10.

When any variable occurs more than one time in any constituent or in any formula, its definition in each occurrence is independent of its definition at every other occurrence. Combinations of substituents and/or variables are permissible only if such combinations result in stable compounds.

It is believed the chemical formulas and names used herein correctly and accurately reflect the underlying chemical compounds. However, the nature and value of the present invention does not depend upon the theoretical correctness of these formulae, in whole or in part. Thus it is understood that the formulas used herein, as well as the chemical names attributed to the correspondingly indicated compounds, are not intended to limit the invention in any way.

EXPERIMENTAL SECTION

Procedure

I. The Inoculant

A conventional aqueous semi-synthetic metal working fluid that had been used in a metal working environment and had tested[i] positive for the presence of Mycobacteria was used to assess the inhibitory effect of several additives for metal working fluid. The metal working fluid was first cultured[ii] on Lowenstein-Jensen agar slant resulting in the growth of cultures identified as Mycobacteria. The Mycobacteria cultures were then used to inoculate an aqueous solution containing 5% fresh semi-synthetic metal working fluid via a standard technique using an inoculation loop. The inoculum in the metal working fluid solution was allowed to grow to form a Mycobacteria-laden inoculant. A Mycobacteria concentration of at least approximately $10^7$ CFU/ml was confirmed by plating the Mycobacteria-laden inoculant on DIFCO Mycobacteria 7H11 agar plates prepared according to the manufacturer's directions. Confirmation of the Mycobacteria concentration was made based upon comparison of the plates to known industry standards.

[i]Testing was performed by a commercial biological laboratory using methods known and considered reliable in that industry for biological classification of bacteria. An example of such testing is the Ziehl-Neelsen Staining technique used to identify Mycobacteria.

[ii]The Mycobacteria-containing metal working fluid was cultured on a Lowenstein-Jensen agar slant by a commercial biological laboratory using known techniques to promote the growth of any viable Mycobacteria present in the metal working fluid.

II. The Test Solutions

One liter solutions were made for testing using 5% aqueous dilutions of the Examples having formulae as recited in Table I. Examples 1 and 2 are compositions according to the invention. Comparative Example 1 is a composition using dicyclohexylamine (DCHA).

A fourth example, Comparative Example 2, was formulated by making a 5% aqueous dilution of a commercially available metal cutting fluid containing DCHA and compounds thereof. Mycobacteria-laden inoculant (50 ml) was added to each one liter test solution. The test solutions were inoculated three times: at zero hours, at twenty-four hours and at forty-eight hours. The inoculated test solutions were plated[iii] at one and twenty-four hours after the first and second inoculations of the test solutions and at one hour after the third inoculation according to the procedure outlined in Experimental Procedure Section I for confirming Mycobacteria concentration. Observations of the plates were then made three weeks after the last inoculation. The results are shown in Table II as powers of ten (e.g. 3 means $10^3$ colonies.

[iii]The bacteria plates were DIFCO Mycobacteria 7H11 agar prepared as their directions recommend.

TABLE I

| Component | Ex. 1 | Ex. 2 | Comparative Ex. 1 |
|---|---|---|---|
| CP300 | 20 | 20 | 20 |
| DI water | 41 | 41.2 | 40 |
| Diglycolamide 5375 | 9 | 9 | 9 |
| Base G7 | 4 | 4 | 4 |
| Addconate M | 3.7 | 3.5 | 3.5 |
| Lubrophos LB-400 | 2 | 2 | 2 |
| CI-750 | 0.25 | 0.25 | 0.25 |
| Isononanoic Acid | 5.7 | 1.8 | 1.5 |
| Ocenol HD 90/95 | 0.7 | | |
| Genapol 0-200 | 3.4 | 2.3 | |
| PA-1618 | 6 | | |
| DA-1214 | | 6 | |
| Dicyclohexylamine | | | 6 |

TABLE II

| | Time, in hours | | | | |
|---|---|---|---|---|---|
| | T = 1 | T = 24 | T = 25 | T = 48 | T = 49 |
| | (Inoculation No.)-(Time of Plating after Inoculation) | | | | |
| | (1)-(1) | (1)-(24) | (2)-(1) | (2)-(24) | (3)-(1) |
| Example 1 | 0 | 0 | 0 | 0 | 4 |
| Example 2 | 3 | 0 | 0 | 0 | 0 |
| Comparative Example 1 | 4 | 0 | 0 | 0 | 3 |
| Comparative Ex. 2 | 3 | 0 | 4 | 0 | 5 |

Key
All results are exponents for $10^x$ except for 0.
0 equals zero, meaning no growth.
(1)-(1) is the first inoculation plated after one hour.
(1)-(24) is the first inoculation plated after 24 hours.
(2)-(1) is the second inoculation plated after one hour.
(2)-(24) is second inoculation plated after 24 hours.
(3)-(1) is third inoculation plated after one hour.

The disclosures of each patent, patent application and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention

What is claimed is:

1. A process for reducing the presence of Mycobacteria in an aqueous alkaline metal working environment, comprising providing to the metal working environment an aqueous metal working fluid incorporating a *Mycobacterium* inhibitory amount of at least one amine of formula Ib:

Ib

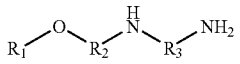

wherein each $R_1$ is independently $C_8$-$C_{10}$ alkyl and each $R_2$ and $R_3$ is —$CH_2CH_2CH_2$—.

2. The process according to claim 1 wherein said aqueous metal working fluid further comprises a workpiece corrosion inhibitor.

3. The process according to claim 2 wherein said workpiece corrosion inhibitor comprises ethanolamine combined with boric acid, a triazole compound, an organic carboxylic acid having 6-10 carbon atoms, a dicarboxylic acid having 10-14 carbon atoms, or any combination thereof.

4. The process according to claim 1 wherein said aqueous metal working fluid comprises about 10 to about 10,000 ppm of said at least one amine.

5. The process according to claim 1 wherein said aqueous metal working fluid comprises about 3,000 to about 6,000 ppm of said at least one amine.

6. The process according to claim 1 wherein said aqueous metal working fluid comprises about 3,000 ppm of said at least one amine.

7. The process according to claim 1 wherein said aqueous metal working fluid further comprises a film-forming additive, an antifoaming agent, or both.

8. A process for reducing the presence of Mycobacteria in an aqueous alkaline metal working environment. comprising providing to the metal working environment an aqueous metal working fluid incorporating a *Mycobacterium* inhibitory amount of at least one amine of formula Ib:

Ib

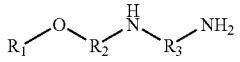

wherein each $R_1$ is independently $C_2$-$C_{18}$ alkyl; and wherein each $R_2$ and $R_3$ is independently $C_2$-$C_4$ alkylene.

9. A process for reducing the presence of Mycobacteria in an aqueous alkaline metal working environment. comprising providing to the metal working environment an aqueous metal working fluid incorporating a *Mycobacterium* inhibitory amount of at least one amine of formula Ib:

Ib

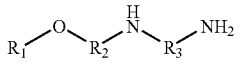

wherein each $R_1$ is independently $C_2$-$C_{10}$ alkyl; and wherein each $R_2$ and $R_3$ is independently $C_2$-$C_4$ alkylene.

10. The process according to claim 1 wherein the aqueous alkaline metal working fluid remains stable after exposure to workpiece-tool contact zone working temperatures.

11. The process according to claim 1 wherein the aqueous alkaline metal working fluid remains effective against growth of *Mycobacterium* after exposure to a workpiece-tool contact zone working pressure of greater than about 60 psi.

12. The process according to claim 1 wherein said aqueous metal working fluid comprises at least about 41% to about 99% water.

13. A process for reducing the presence of Mycobacteria in an aqueous alkaline metal working environment. comprising providing to the metal working environment an aqueous metal working fluid incorporating a *Mycobacterium* inhibitory amount of at least one amine of formula Ia or Ib:

Ib

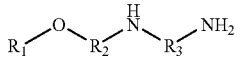

wherein each $R_1$ is independently $C_2$-$C_{18}$ alkyl;

wherein each $R_2$ and $R_3$ is independently $C_2$-$C_4$ alkylene; and wherein said aqueous metal working fluid incorporates more than one amine of formula Ia or Ib.

14. The process according to claim 13 at least one of said more than one amine has the formula Ia wherein $R_1$ is $C_2$-$C_9$ alkyl.

15. The process according to claim 13 wherein said aqueous metal working fluid incorporates a *Mycobacterium* inhibitory amount of at least two straight-chain amines of formula Ia or Ib, wherein $R_1$ is $C_2$-$C_{10}$ alkyl.

16. The process according to claim 8 wherein said aqueous metal working fluid further comprises a workpiece corrosion inhibitor.

17. The process according to claim 16 wherein said workpiece corrosion inhibitor comprises ethanolamine combined with boric acid, a triazole compound, an organic carboxylic acid having 6-10 carbon atoms, a dicarboxylic acid having 10-14 carbon atoms, or any combination thereof.

18. The process according to claim 8 wherein said aqueous metal working fluid comprises about 10 to about 10,000 ppm of said at least one amine.

19. The process according to claim 8 wherein said aqueous metal working fluid comprises about 3,000 to about 6,000 ppm of said at least one amine.

20. The process according to claim 8 wherein said aqueous metal working fluid comprises about 3,000 ppm of said at least one amine.

21. The process according to claim 8 wherein said aqueous metal working fluid further comprises a film-forming additive, an antifoaming agent, or both.

22. The process according to claim 8 wherein the aqueous alkaline metal working fluid remains stable after exposure to workpiece-tool contact zone working temperatures.

23. The process according to claim 8 wherein the aqueous alkaline metal working fluid remains effective against growth of *Mycobacterium* after exposure to a workpiece-tool contact zone working pressure of greater than about 60 psi.

24. The process according to claim 8 wherein said aqueous metal working fluid comprises at least about 41% to about 99% water.

25. The process according to claim 9 wherein said aqueous metal working fluid further comprises a workpiece corrosion inhibitor.

26. The process according to claim 25 wherein said workpiece corrosion inhibitor comprises ethanolamine combined with boric acid, a triazole compound, an organic carboxylic acid having 6-10 carbon atoms, a dicarboxylic acid having 10-14 carbon atoms, or any combination thereof.

27. The process according to claim 9 wherein said aqueous metal working fluid comprises about 10 to about 10,000 ppm of said at least one amine.

28. The process according to claim 9 wherein said aqueous metal working fluid comprises about 3,000 to about 6,000 ppm of said at least one amine.

29. The process according to claim 9 wherein said aqueous metal working fluid comprises about 3,000 ppm of said at least one amine.

30. The process according to claim 9 wherein said aqueous metal working fluid further comprises a film-forming additive, an antifoaming agent, or both.

31. The process according to claim 9 wherein the aqueous alkaline metal working fluid remains stable after exposure to workpiece-tool contact zone working temperatures.

32. The process according to claim 9 wherein the aqueous alkaline metal working fluid remains effective against growth of *Mycobacterium* after exposure to a workpiece-tool contact zone working pressure of greater than about 60 psi.

33. The process according to claim 9 wherein said aqueous metal working fluid comprises at least about 41% to about 99% water.

34. The process according to claim 13 wherein said aqueous metal working fluid further comprises a workpiece corrosion inhibitor.

35. The process according to claim 34 wherein said workpiece corrosion inhibitor comprises ethanolamine combined with boric acid, a triazole compound, an organic carboxylic acid having 6-10 carbon atoms, a dicarboxylic acid having 10-14 carbon atoms, or any combination thereof.

36. The process according to claim 13 wherein said aqueous metal working fluid comprises about 10 to about 10,000 ppm of said at least one amine.

37. The process according to claim 13 wherein said aqueous metal working fluid comprises about 3,000 to about 6,000 ppm of said at least one amine.

38. The process according to claim 13 wherein said aqueous metal working fluid comprises about 3,000 ppm of said at least one amine.

39. The process according to claim 13 wherein said aqueous metal working fluid further comprises a film-forming additive, an antifoaming agent, or both.

40. The process according to claim 13 wherein the aqueous alkaline metal working fluid remains stable after exposure to workpiece-tool contact zone working temperatures.

41. The process according to claim 13 wherein the aqueous alkaline metal working fluid remains effective against growth of *Mycobacterium* after exposure to a workpiece-tool contact zone working pressure of greater than about 60 psi.

42. The process according to claim 13 wherein said aqueous metal working fluid comprises at least about 41% to about 99% water.

* * * * *

UNITED STATES PATENT AND TRADEMARK OFFICE

CERTIFICATE OF CORRECTION

PATENT NO. : 7,595,288 B2
APPLICATION NO. : 11/051362
DATED : September 29, 2009
INVENTOR(S) : Mark J. Fretz et al.

It is certified that error appears in the above-identified patent and that said Letters Patent is hereby corrected as shown below:

Column 8,
Line 39, delete "a bout" and insert -- about --.

Column 10,
Line 60, after "invention" insert -- . --.

Column 11,
Line 45, delete "environment." and insert -- environment, --.

Column 12,
Line 2, delete "environment." and insert -- environment, --.
Lines 6-10, insert missing formula Ia as follows:

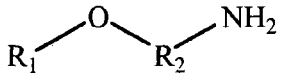

-- Ia --.

Line 18, after "claim 13" insert -- wherein --.

Signed and Sealed this
Twenty-second Day of March, 2011

David J. Kappos

David J. Kappos
*Director of the United States Patent and Trademark Office*